US007962053B2

(12) United States Patent
Kim

(10) Patent No.: US 7,962,053 B2
(45) Date of Patent: Jun. 14, 2011

(54) METHOD AND DEVICE FOR CONTROLLING SUPPLY OF DEVELOPER

(75) Inventor: Hyo-Seok Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1043 days.

(21) Appl. No.: 11/598,838

(22) Filed: Nov. 14, 2006

(65) Prior Publication Data

US 2007/0110456 A1 May 17, 2007

(30) Foreign Application Priority Data

Nov. 17, 2005 (KR) ..... 10-2005-0110130

(51) Int. Cl.
*G03G 15/08* (2006.01)

(52) U.S. Cl. ..... 399/27; 399/53; 399/61; 399/258; 399/260

(58) Field of Classification Search ..... 399/27, 399/53, 61, 258, 260
See application file for complete search history.

(56) References Cited

U.S. PATENT DOCUMENTS 4,032,227 A * 6/1977 Hubbard et al. ..... 399/30
4,942,431 A * 7/1990 Tada ..... 399/58
4,975,742 A * 12/1990 Tada et al. ..... 399/62
4,985,823 A * 1/1991 Tada et al. ..... 399/59
5,150,135 A * 9/1992 Casey et al. ..... 347/125
5,253,020 A * 10/1993 Matsushita et al. ..... 399/30
5,717,973 A * 2/1998 Endoh et al. ..... 399/29
5,754,916 A * 5/1998 Kitayama et al. ..... 399/27
5,987,272 A * 11/1999 Maeda et al. ..... 399/58
6,006,050 A * 12/1999 Watanabe et al. ..... 399/58
6,078,761 A * 6/2000 de Waal ..... 399/61
6,345,162 B1 * 2/2002 Ozawa et al. ..... 399/61
6,526,252 B1 * 2/2003 Itoh et al. ..... 399/359
6,640,060 B2 * 10/2003 Yamaguchi et al. ..... 399/27
6,690,896 B2 * 2/2004 Hanada et al. ..... 399/27
6,917,767 B2 * 7/2005 Kabashima ..... 399/27
(Continued)

FOREIGN PATENT DOCUMENTS

CN 1670632 A 9/2005
(Continued)

*Primary Examiner* — David M Gray
*Assistant Examiner* — Geoffrey T. Evans
(74) *Attorney, Agent, or Firm* — Roylance, Abrams, Berdo & Goodman, LLP

(57) ABSTRACT

A method and a device for controlling a supply of a developer are provided. An amount of the developer is sensed during warm-up and a determination is made as to whether the sensed amount is equal to or less than a predetermined threshold during warm-up. The developer is supplied during warm-up and the amount of the developer is sensed when a determination is made that the sensed amount is equal to or less than the threshold. The supplying of the developer is stopped during warm-up when a determination is made that the sensed amount is greater than the threshold. Also, the method may include determining whether an amount of the developer is greater than a predetermined threshold by analyzing a given flag and stopping the supply of the developer and forming an image using the developer, when it is determined that the amount of the developer is greater than the threshold. In addition, the method may include determining whether an amount of the developer is greater than a predetermined threshold by analyzing a given flag after completing a printing job and stopping the supply of the developer when it is determined that the amount of the developer is greater than the threshold after completing a printing job.

11 Claims, 5 Drawing Sheets

U.S. PATENT DOCUMENTS

| | | | | |
|---|---|---|---|---|
| 7,065,305 | B2 | 6/2006 | Oyaide | |
| 7,603,065 | B2 * | 10/2009 | Yamaguchi et al. | 399/258 |
| 2003/0123889 | A1 * | 7/2003 | Isobe et al. | 399/27 |
| 2005/0063714 | A1 * | 3/2005 | Kinoshita et al. | 399/27 |
| 2005/0063716 | A1 * | 3/2005 | Fujiwara | 399/27 |
| 2005/0117919 | A1 * | 6/2005 | Ito et al. | 399/27 |
| 2005/0207764 | A1 | 9/2005 | Oyaide | |
| 2005/0238369 | A1 * | 10/2005 | Nakano et al. | 399/27 |
| 2005/0265738 | A1 * | 12/2005 | Ogata | 399/27 |
| 2006/0002724 | A1 * | 1/2006 | Fujimori et al. | 399/27 |
| 2006/0127109 | A1 * | 6/2006 | Itoyama et al. | 399/27 |
| 2008/0019712 | A1 * | 1/2008 | Tanaka et al. | 399/30 |

FOREIGN PATENT DOCUMENTS

| | | |
|---|---|---|
| JP | 09-138560 | 5/1997 |
| JP | 10-274881 | 10/1998 |
| JP | 2004-092200 | 4/2001 |
| JP | 1020030054884 | 7/2003 |
| KR | 2003-54884 | 7/2003 |

* cited by examiner

METHOD AND DEVICE FOR CONTROLLING SUPPLY OF DEVELOPER

CROSS-REFERENCE TO RELATED PATENT APPLICATION

This application claims the benefit under 35 U.S.C. §119 (a) of Korean Patent Application No. 10-2005-0110130, filed on Nov. 17, 2005, in the Korean Intellectual Property Office, the entire disclosure of which is hereby incorporated by reference.

BACKGROUND OF THE INVENTION

1. Field of the Invention

The present invention relates to controlling a supply of a developer. More particularly, the present invention relates to a method and a device for controlling a supply of a developer to a developing device to maintain an amount of the developer contained in the developing device equal to or greater than a predetermined amount.

2. Description of the Related Art

An image forming apparatus such as a laser printer includes an exposing unit and a developing unit. The exposing unit forms an electrostatic latent image by exposing a photosensitive drum to light in accordance with given print data. Also, the developing unit develops the electrostatic latent image by using a developer. The development result is transferred on a print medium and output as a printed image.

The developing unit includes one or more developing devices. Specifically, a developing unit of a mono laser printer that performs black-and-white printing includes one developing device, and a developing unit of a color laser printer that performs color printing includes a plurality of developing devices.

An amount of the developer equal to or greater than a predetermined amount has to be contained in the developing device to prevent a poor quality image with low printing concentration, which is visible to the naked eye from being output.

Although the amount of the developer may always remain equal to or greater than the predetermined amount in a conventional image forming apparatus, printing is performed even when the amount of the developer is very low. Therefore, a low quality image is occasionally printed. Accordingly, techniques for controlling the developer supply to the developing device are required to maintain the amount of the developer contained in the developing device equal to or greater than the predetermined amount.

SUMMARY OF THE INVENTION

An aspect of exemplary embodiments of the present invention is to address at least the above problems and/or disadvantages and to provide at least the advantages described below. Accordingly, an aspect of exemplary embodiments of the present invention is to provide a method of controlling a supply of a developer to a developing device to maintain an amount of the developer contained in the developing device equal to or greater than a predetermined amount.

An exemplary embodiment of the present invention also provides a device for controlling a supply of a developer to a developing device to maintain an amount of the developer contained in the developing device equal to or greater than a predetermined amount.

According to an aspect of an exemplary embodiment of the present invention, a method of controlling a supply of a developer is provided. An amount of the developer is sensed and a determination is made as to whether the sensed amount is equal to or less than a predetermined threshold during a warm-up operation. The developer is supplied and then an amount of the developer is sensed and a determination is made as to whether the sensed amount is equal to or less than the threshold during the warm-up operation. The developer is no longer supplied when it is determined that the sensed amount is greater than the threshold during the warm-up operation.

According to another aspect of an exemplary embodiment of the present invention, a method of controlling a supply of a developer is provided. A determination is made as to whether an amount of the developer is greater than a predetermined threshold by analyzing a given flag. The supply of the developer is stopped and an image is formed using the developer, when a determination is made that the amount of the developer is greater than the threshold, wherein the flag indicates the result of comparing the threshold with the amount of the developer sensed during a warm-up operation.

According to another aspect of an exemplary embodiment of the present invention, a method of controlling a supply of a developer is provided. A determination is made as to whether an amount of the developer is greater than a predetermined threshold by analyzing a given flag. The supply of the developer is stopped when it is determined that the amount of the developer is greater than the threshold. A determination is made as to whether an amount of the developer is greater than a predetermined threshold by analyzing a given flag immediately after a printing job is completed and the flag indicates the result of the comparison between the threshold and the amount of the developer sensed while a printing job is being performed. The supply of the developer is also stopped when a determination is made that the amount of the developer is greater than the threshold after a printing job is completed and the flag serves as an indication of the result of the comparison between the threshold and the amount of the developer sensed while a printing job is being performed.

According to another aspect of an exemplary embodiment of the present invention, a device for controlling a supply of a developer is provided. The device comprises a sensing unit, a determination unit and a developer supply unit. The sensing unit senses an amount of the developer in response to a first or second sensing instruction signal. The determination unit compares the sensed amount with a predetermined threshold and outputs the comparison result as a first supply control signal. The developer supply unit controls the supply of the developer in accordance with the first supply control signal, wherein the first sensing instruction signal is generated during a warm-up operation, and the second sensing instruction signal is generated in accordance with the first supply control signal.

According to another aspect of an exemplary embodiment of the present invention, a device for controlling a supply of a developer is provided. The device comprises a flag analyzing unit, a sensing unit, a developer supply unit, and a determination unit. The flag analyzing unit analyzes a given flag in response to a print instruction signal and outputs the analysis result as a second supply control signal. The sensing unit senses an amount of the developer in response to the second supply control signal. The developer supply unit controls the supply of the developer in accordance with a first supply control signal or the second supply control signal. The determination unit compares the sensed result with a predetermined threshold and outputs the comparison result as the first supply control signal, wherein the flag indicates the result of comparing the threshold with the amount of the developer sensed during a warm-up operation.

According to another aspect of the present invention, a device for controlling a supply of a developer is provided. The device comprises a flag analyzing unit, a sensing unit, a developer supply unit and a determination unit. The flag analyzing unit analyzes a given flag in response to a post mode entrance instruction signal and outputs the analysis result as a second supply control signal. The sensing unit senses an amount of the developer in response to the second supply control signal. The developer supply unit controls the supply of the developer in accordance with a first supply control signal or the second supply control signal. The determination unit compares the sensed result with a predetermined threshold and outputs the comparison result as the first supply control signal, wherein the flag indicates the result of comparing the threshold with the amount of the developer sensed while a printing job is being performed.

Other objects, advantages and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other exemplary objects, features and advantages of certain exemplary embodiments of the present invention will be more apparent from the following description taken in conjunction with the accompanying drawings in which.

Throughout the drawings, the same drawing reference numerals will be understood to refer to the same elements, features and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
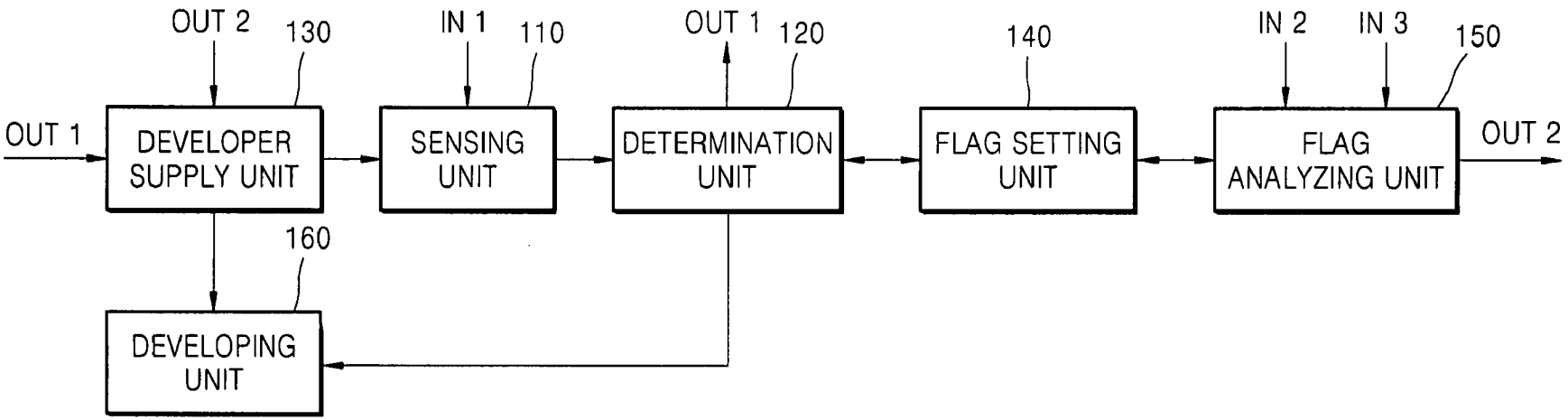
FIG. 1 is a block diagram for explaining a device for controlling a supply of a developer according to an exemplary embodiment of the present invention.

FIG. 1 is a block diagram of a device for controlling a supply of a developer according to an exemplary embodiment of the present invention. The device for controlling the supply of the developer includes a sensing unit 110, a determination unit 120, a developer supply unit 130, a flag setting unit 140, a flag analyzing unit 150, and a developing unit 160.

An image forming apparatus such as a multi function peripheral (MFP) or printer may include the aforementioned elements 110 to 160. Here, the printer may be a mono laser printer that performs black-and-white printing or a color laser printer that performs color printing.

Alternatively, a toner is an example of the developer used in an exemplary embodiment of the present invention. The developer is contained in a developing device of an image forming apparatus, more specifically, a cartridge of the developing device. A container containing the developer is connected to the cartridge. A clutch is included between the container and the cartridge. The developer is supplied from the container to the cartridge only when the clutch operates.

The control, according to an exemplary embodiment of the present invention, may be constantly performed. According to an exemplary embodiment of the present invention, the control is performed during a warm-up operation of the image forming apparatus. The control, according to another exemplary embodiment of the present invention, is performed from a time when a print instruction is received to a time when a printing job is completed. The control, according to still another exemplary embodiment of the present invention is performed after the printing job is completed.

The warm-up operation is an operation in which the parameters for performing the printing job are provided. The warm-up operation is performed when the image forming apparatus is powered on, and also performed immediately before the printing job is performed.

The control, according to the above exemplary embodiments of the present invention, will be explained in detail below.

When the device for controlling the supply of the developer includes the sensing unit 110, the determination unit 120, the developer supply unit 130, and the flag setting unit 140, according to an exemplary embodiment of the present invention, the control is performed during a warm-up operation.

The sensing unit 110 senses the amount of the developer contained in the developing device in response to a first or a second sensing instruction signal. The first sensing instruction signal IN 1 is generated during the warm-up operation, and the second sensing instruction signal IN 2 is generated in accordance with a next first supply control signal.

The determination unit 120 compares the amount sensed by the sensing unit 110 with a predetermined threshold and outputs a comparison result as the first supply control signal OUT 1. Specifically, the determination unit 120 outputs the first supply control signal for instructing the developer supply unit 130 to continuously supply the developer when the sensed amount is equal to or less than the threshold. On the contrary, the determination unit 120 outputs the first supply control signal for instructing the developer supply unit 130 to stop the supply of the developer when the sensed amount is greater than the threshold.

Alternatively, the determination unit 120 determines whether a warm-up completion time has passed and may output the first supply control signal in response to the determination result or the comparison result.

The developer supply unit 130 receives the fist supply control signal and controls the supplying of the developer to the developing device in accordance with the first supply control signal.

Alternatively, the flag setting unit 140 receives the first supply control signal and sets the flag in response to the first supply control signal. Specifically, the flag setting unit 140 sets data indicating the comparison result of comparing the amount of the developer sensed by the sensing unit 110 during the warm-up operation with the threshold as the flag.

More specifically, the flag setting unit 140 can set the flag to 0 when the determination unit 120 determines that the amount sensed by the sensing unit 110 is equal to or less than the threshold and determines that the warm-up completion time has passed. On the contrary, the flag setting unit 140 can set the flag to 1 when the determination unit 120 determines that the amount sensed by the sensing unit 110 is greater than the threshold.

According to an exemplary implementation, 0 indicates false, and 1 indicates true. Specifically, 0 indicates that the probability of producing a poor quality print-out is high, and 1 indicates that the probability of producing a poor quality print-out is low, when an electrostatic latent image is developed using the developer contained in the developing device.

In another exemplary embodiment of the present invention, the device for controlling the supply of the developer includes the elements 110 to 160.

The flag analyzing unit 150 operates in response to a print instruction signal IN 2. Specifically, the flag analyzing unit 150 analyzes the flag set by the flag setting unit 140 which is similar to the previous exemplary embodiment of the present invention in response to the print instruction signal and outputs the analysis result as the second supply control signal. In an exemplary embodiment of the present invention, the analyzed flag indicates the result of comparing the amount of the developer sensed by the sensing unit during the warm-up operation with the threshold.

The sensing unit 110 senses the amount of the developer contained in the developing device in response to the second supply control signal. Specifically, the sensing unit 110 senses the amount in response to the second supply control signal when the flag analyzed by the flag analyzing unit 150 is 0.

The developer supply unit 130 controls the supply of the developer to the developing device in response to the first or second supply control signal. According to an exemplary implementation, the first supply control signal is output from the determination unit 120, and then the determination unit 120 compares the amount of the developer sensed by the sensing unit 110 with the threshold in response to the second supply control signal.

According to an exemplary implementation, the determination unit 120 outputs the first supply control signal for instructing the developer supply unit 130 to stop the supplying of the developer when a determination is made that the sensed amount of the developer is equal to or less than the threshold. On the contrary, the determination unit 120 outputs the first supply control signal for instructing the developer supply unit 130 to supply continuously the developer when it is determined that the sensed amount of the developer is greater than the threshold. Then, the determiner 120 determines whether a print starting time has passed and may output the first supply control signal in response to the determination result or the comparison result.

Alternatively, the flag setting unit 140 sets data which serves as an indication of the comparison result of comparing the amount of the developer sensed by the sensing unit 110 during the warm-up operation with the threshold as the flag. Specifically, the flag setting unit 140 changes the flag which is set in the previous exemplary embodiment of the present invention with data indicating the comparison result of comparing the threshold with the amount of the developer sensed by the sensing unit 110 immediately before the printing job is completed.

More specifically, the flag setting unit 140 can set the flag to 0 when the determination unit 120 determines that the amount sensed by the sensing unit 110 is equal to or less than the threshold. On the contrary, the flag setting unit 140 can set the flag to 1 when the determination unit 120 determines that the amount sensed by the sensing unit 110 is greater than the threshold.

The developing unit 160 develops an electrostatic latent image by using the developer remaining in the developing device when the developer supply unit 130 stops supplying the developer to the developing device.

According to the still another exemplary embodiment of the present invention, the device for controlling the supply of the developer includes the elements 110 to 160.

The flag analyzing unit 150 operates in response to a post mode entrance instruction signal IN 3. Specifically, the flag analyzing unit 150 analyzes the flag set by the flag setting unit 140 in response to the post mode entrance instruction signal and outputs the analysis result as the second supply control signal. In the exemplary embodiment of the present invention, the analyzed flag indicates the comparison result of comparing the threshold with the amount of the developer sensed by the sensing unit while printing.

The sensing unit 110 senses the amount of the developer contained in the developing device in response to the second supply control signal. Specifically, the sensing unit 110 senses the amount of the developer in response to the second supply control signal when the flag analyzed by the flag analyzing unit 150 according to the previous exemplary embodiment of the present invention is 0.

The developer supply unit 130 controls the supplying of the developer to the developing device in response to the first or second supply control signal. Here, the first supply control signal is output from the determination unit 120, and then the determination unit 120 compares the amount of the developer sensed by the sensing unit 110 with the threshold in response to the second supply control signal.

According to an exemplary implementation, the determination unit 120 outputs the first supply control signal for instructing the developer supply unit 130 to stop the supplying of the developer when it is determined that the sensed amount of the developer is equal to or less than the threshold. On the contrary, the determination unit 120 outputs the first supply control signal for instructing the developer supply unit 130 to continuously supply the developer when a determination is made that the sensed amount of the developer is greater than the threshold. Then, the determiner 120 determines whether a post print mode completion time has passed and may output the first supply control signal by reflecting the determination result or the comparison result.

Figure 2:
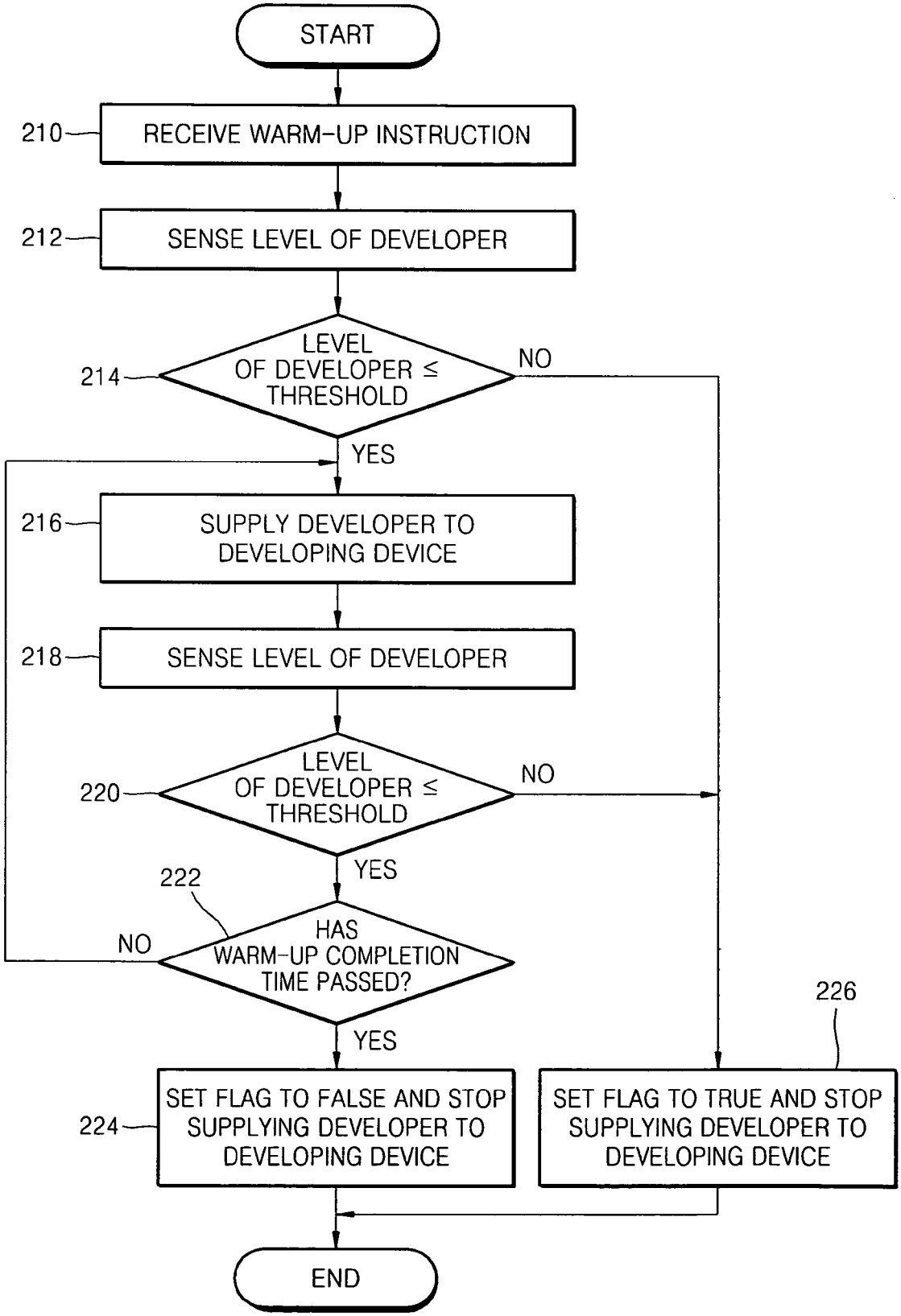
FIG. 2 is a flowchart for explaining a method of controlling a supply of a developer according to an exemplary embodiment of the present invention.

FIG. 2 is a flowchart illustrating a method of controlling the supply of the developer according to an exemplary embodiment of the present invention. The method of FIG. 2 will be described in conjunction with FIG. 1 and the case in which the control is performed during a warm-up operation of the image forming apparatus. The method of controlling a supply of the developer includes steps 210 to 226 of controlling the supply of the developer to the developing device to maintain the amount of the developer contained in the developing device equal to or greater than a constant amount.

The image forming apparatus receives a warm-up instruction (step 210). The sensing unit 110 senses the amount of the developer contained in the developing device (step 212). After step 212, the determination unit 120 determines whether the amount sensed in step 212 is equal to or less than the threshold (step 214).

The developer supply unit 130 continuously supplies the developer to the developing device (step 216) when a determination is made that the amount sensed in step 212 is equal to or less than the threshold. The sensing unit senses the amount of the developer (step 218). The determination unit 120 determines whether the amount sensed in step 218 is equal to or less than the threshold (step 220).

The determination unit 120 determines whether the warm-up completion time has passed when it is determined in step 220 that the amount sensed in step 218 is equal to or less than the threshold (step 222). The flag setting unit 150 sets the flag to 0 and the developer supply unit 130 stops supplying the developer to the developing device when it is determined that the warm-up completion time has passed (step 224). On the contrary, the method proceeds to step 216 when it is determined that the warm-up completion time has not passed.

On the other hand, the flag setting unit 150 sets the flag to 1 and the developer supply unit 130 stops the supply of the developer to the developing device when it is determined in step 214 that the amount sensed in step 212 is greater than the threshold (step 226).

Figure 3A:
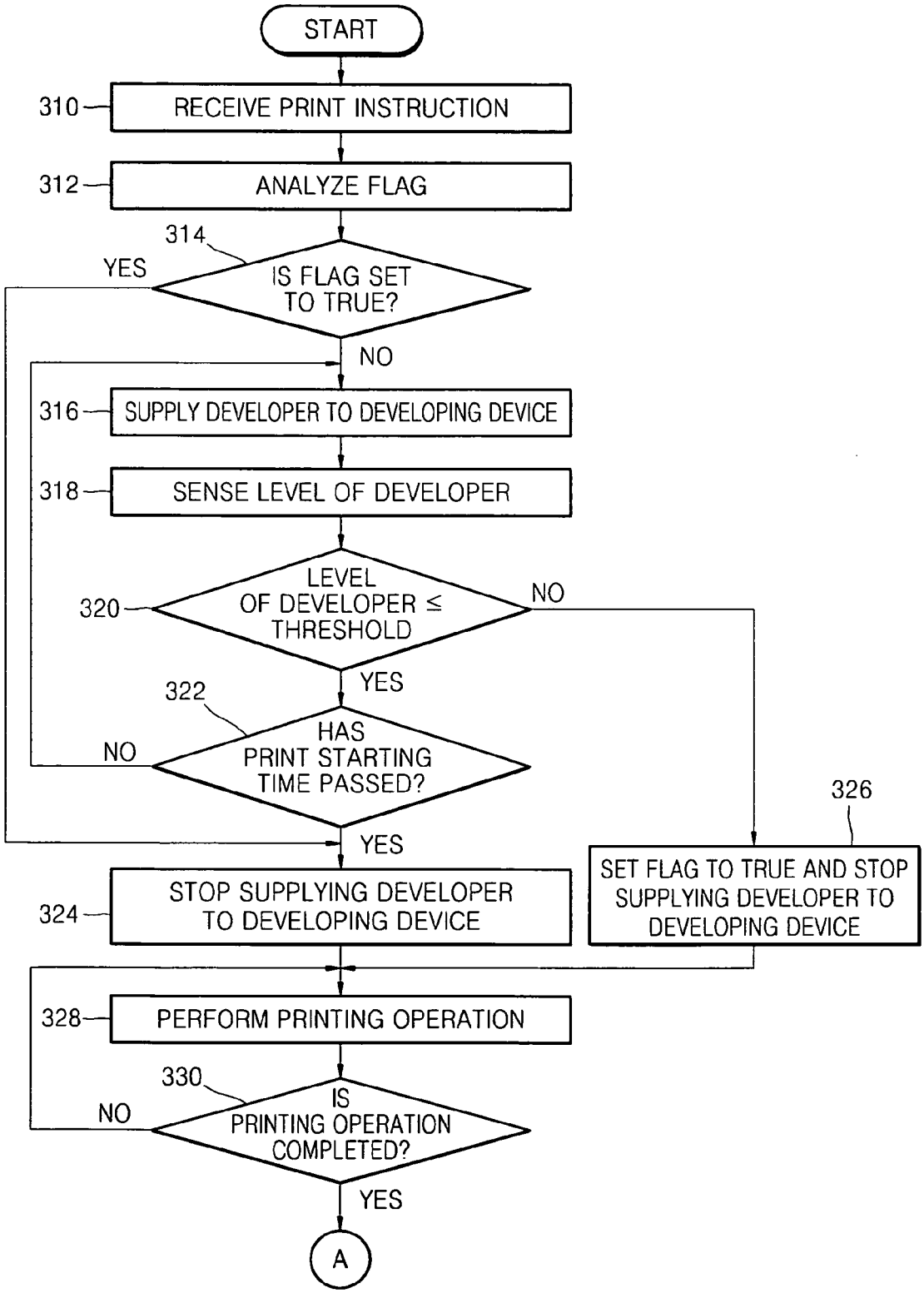
FIG. 3A and FIG. 3B are flowcharts for explaining a method of controlling a supply of a developer according to another exemplary embodiment of the present invention.
Figure 3B:
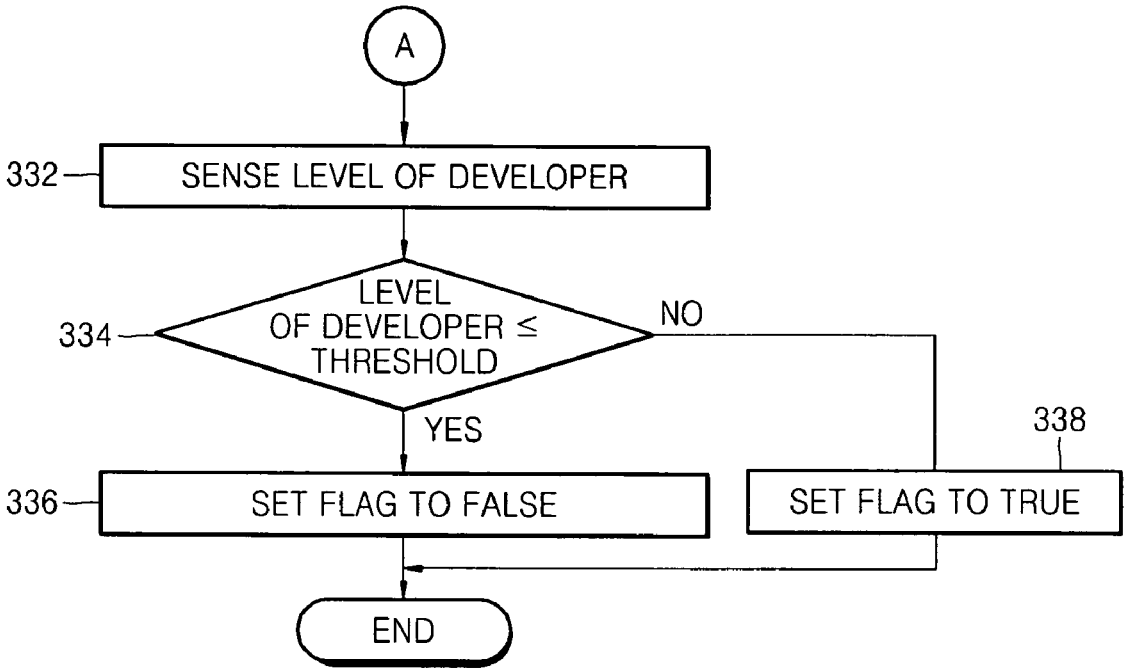

FIG. 3 is a flowchart for explaining a method of controlling the supply of developer according to another exemplary embodiment of the present invention. The method of FIG. 3 will be described in conjunction with FIG. 1 and the case in which the control is performed is performed from a time when a print instruction is received to a time when a printing job is completed. The method of controlling the supply of the developer includes steps 310 to 338 of controlling the supply of the developer to the developing device to maintain the amount of the developer contained in the developing device equal to or greater than a constant amount.

The image forming apparatus receives a print instruction (step 310). The flag analyzing unit 150 analyzes the flag set by the flag setting unit 140 like in the exemplary embodiment of the present invention (step 312) and determines whether the flag is 0 or 1 (step 314).

The developer supply unit 130 continuously supplies the developer to the developing device when it is determined in step 314 that the flag is 0 (step 316). The sensing unit 110 senses the amount of the developer (step 318). The determination unit 120 determines whether the amount sensed in step 318 is equal to or less than the threshold (step 320).

The determination unit 120 determines whether the print starting time has passed when a determination is made that the amount sensed in step 318 is equal to or less than the threshold (step 322). The developer supply unit 130 stops the supply of the developer to the developing device when a determination is made in step 322 that the print starting time has passed (step 324). On the contrary, the method proceeds to step 316 when it is determined in step 322 that the print starting time has not passed.

On the contrary, the flag setting unit 140 sets the flag to 1 and the developer supply unit 130 stops the supply of the developer to the developing device when it is determined in step 320 that the amount sensed in step 318 is greater than the threshold (step 326).

Alternatively, the operation proceeds to step 324 when it is determined in step 314 that the flag is 1.

After step 324 or step 326, the developing unit 160 develops the electrostatic latent image using the developer (step 328). The determination unit 120 determines whether the printing operations, according to the print instruction in step 310, are completed (step 330).

While the method proceeds to step 328 when a determination is made in step 330 that the printing operations are not completed, the sensing unit 110 senses the amount of the developer when it is determined in step 330 that the printing operations are completed (step 332).

After step 332, the determination unit 120 determines whether the amount sensed in step 332 is equal to or less than the threshold (step 334). The flag setting unit 140 sets the flag to 0 when a determination is made, in step 334, that the amount sensed in step 332 is equal to or less than the threshold (step 336). On the contrary, the flag setting unit 140 sets the flag to 1 when it is determined in step 334 that the amount sensed in step 332 is greater than the threshold (step 338).

Figure 4:
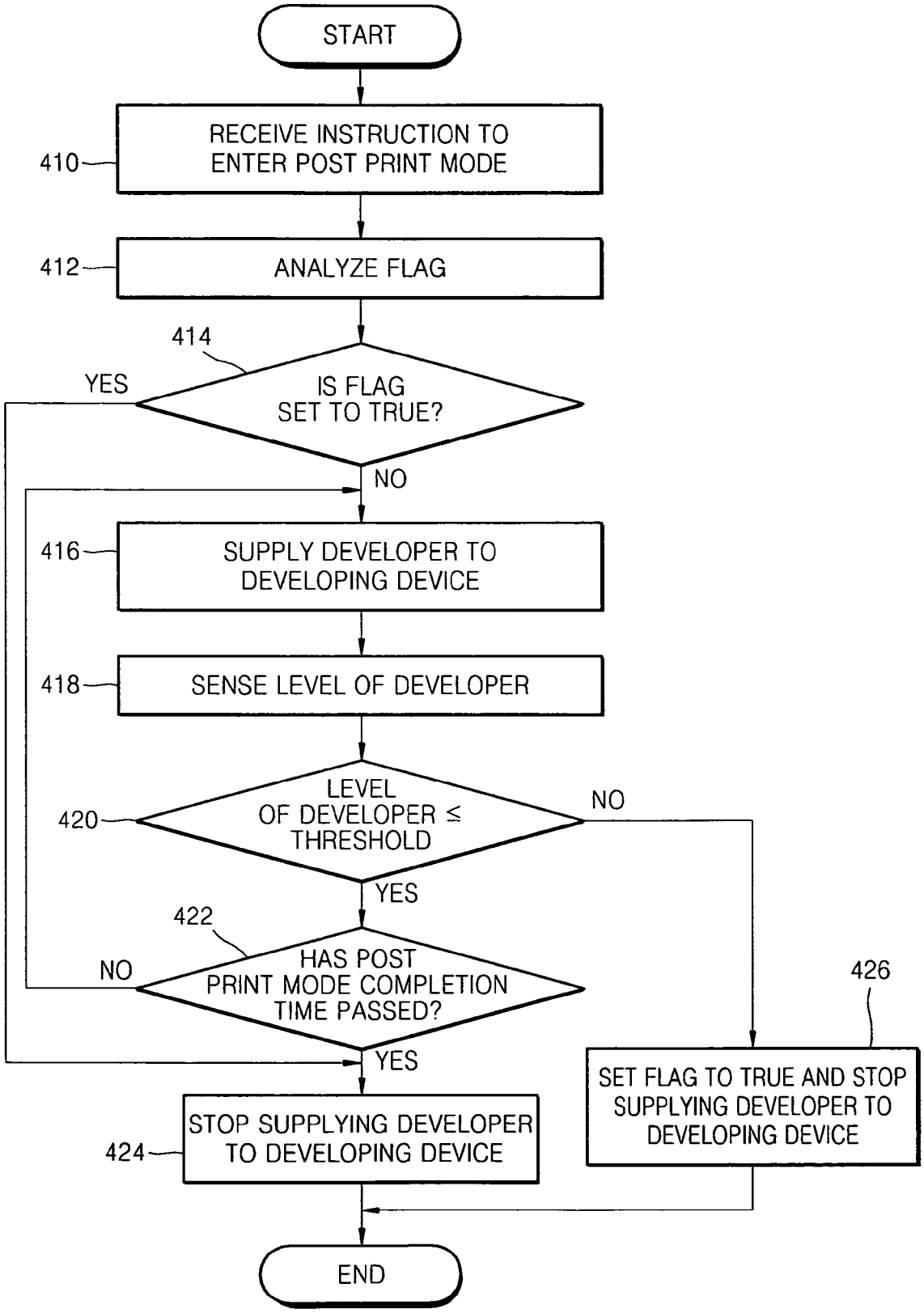
FIG. 4 is a flowchart for explaining a method of controlling a supply of a developer according to still another exemplary embodiment of the present invention.

FIG. 4 is a flowchart illustrating a method of controlling the supply of the developer according to still another exemplary embodiment of the present invention. The method of FIG. 4 will be described in conjunction with FIG. 1 and the case where the control is performed after the printing job is completed. The method of controlling the supply of the developer includes steps 410 to 426 of controlling the supply of the developer to the developing device to maintain the amount of the developer contained in the developing device equal to or greater than a constant amount.

The image forming apparatus is instructed to enter the post print mode (step 410). The flag analyzing unit 150 analyzes the flag set by the flag setting unit 140 according to the previous exemplary embodiment of the present invention (step 412) and determines whether the flag is 0 or 1 (step 414).

The developer supply unit 130 continuously supplies the developer to the developing device when a determination is made in step 414 that the flag is 0 (step 416). The sensing unit 110 senses the amount of the developer (step 418). The determination unit 120 determines whether the amount sensed in step 418 is equal to or less than the threshold (step 420).

The determination unit 120 determines whether the post print mode completion time has passed when a determination is made that the amount sensed in step 418 is equal to or less than the threshold (step 422). The developer supply unit 130 stops the supply of the developer to the developing device when a determination is made in step 422 that the print starting time has passed (step 424). Alternatively, the method proceeds to step 416 when a determination is made in step 422 that the print starting time has not passed.

On the contrary, the flag setting unit 140 sets the flag to 1 and the developer supply unit 130 stops the supply of the developer to the developing device when it is determined in step 420 that the amount sensed in step 418 is greater than the threshold (step 426).

Alternatively, the method proceeds to step 424 when a determination is made in operation 414 that the flag is 1.

The invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing exemplary embodiments of the present invention can be easily construed by programmers skilled in the art to which the present invention pertains.

As described above, the method and the device for controlling the supply of developer according to the present invention can prevent poor print-out quality by controlling the supply of the developer to a developing device to maintain an amount of the developer contained in the developing device equal to or greater than a constant amount.

While the present invention has been shown and described with reference to certain exemplary embodiments thereof, it will be understood by those of ordinary skill in the art that various changes in form and details may be made therein without departing from the spirit and scope of the invention as defined by the appended claims and their equivalents.

What is claimed is:

1. A method of controlling a supply of a developer, the method comprising:

sensing an amount of the developer;

determining whether the sensed amount is equal to or less than a predetermined threshold;

supplying the developer and repeating the sensing when a determination is made that the sensed amount is equal to or less than the threshold; and stopping the supplying of the developer when a determination is made that the sensed amount is greater than the threshold;

wherein the sensing, the determining, the supplying and the stopping are performed during a warm-up operation; and wherein the supplying comprises:

determining whether a warm-up completion time has passed when it is determined that the sensed amount is equal to or less than the threshold, and stopping the supplying of the developer when it is determined that the warm-up completion time has passed; and changing a given flag to a value indicating the result of comparing the sensed amount of the developer with the threshold, when it is determined that the warm-up completion time has passed;

wherein said flag is analyzed at a future time to determine whether an amount of the developer is greater than the threshold.

2. The method of claim 1, wherein the supplying further comprises supplying the developer and repeating the sensing, when a determination is made that the warm-up completion time has not passed.

3. A method of controlling a supply of a developer, the method comprising:

determining whether an amount of the developer is greater than a predetermined threshold by analyzing a given flag; and stopping supplying the developer and forming an image using the developer, when it is determined that the amount of the developer is greater than the threshold, wherein the flag indicates the result of comparing the threshold with the amount of the developer sensed during a warm-up operation; and wherein, when it is determined in the determining that the amount of the developer is equal to or less than the threshold, the method further comprises:

continuing the supplying of the developer, sensing the amount of the developer, and determining whether the amount of the developer is equal to or less than the threshold;

stopping the supplying of the developer and forming the image using the developer, when a determination is made in the continuing that the amount of the developer is greater than the threshold; and repeating the continuing after a determination is made in the continuing that the amount of the developer is equal to or less than the threshold;

wherein the repeating the continuing comprises:

determining whether a print starting time has passed when a determination is made in a current instance of the continuing that the amount of the developer is equal to or less than the threshold;

stopping the supplying of the developer and forming the image using the developer, when a determination is made that the print starting time has passed; and again repeating the continuing after a determination is made that the print starting time has not passed.

4. The method of claim 3, further comprising sensing the amount of the developer after the developer is supplied and the image is formed using the developer once a determination is made that the amount of the developer is greater than the threshold and changing the flag to a value indicating the result of comparing the sensed amount of the developer with the threshold.

5. The method of claim 3, further comprising sensing the amount of the developer after stopping the supply of the developer and forming the image using the developer, when a determination is made in a current instance of the continuing that the amount of the developer is greater than the threshold.

6. A method of controlling a supply of a developer, the method comprising:

determining whether an amount of the developer is greater than a predetermined threshold by analyzing a given flag; and stopping a supply of the developer when a determination is made that the amount of the developer is greater than the threshold, wherein the determining and the stopping are performed immediately after completing a printing job and the flag indicates the result of comparing the threshold with the amount of the developer sensed while a printing job is being performed;

wherein, when a determination is made that the amount of the developer is equal to or less than the threshold, the method further comprises:

continuing the supplying of the developer, sensing the amount of the developer, and determining whether the amount of the developer is equal to or less than the threshold;

stopping the supplying of the developer when a determination is made in the continuing that the amount of the developer is greater than the threshold; and repeating the continuing after it is determined in the continuing that the amount of the developer is equal to or less than the threshold;

wherein the repeating the continuing comprises:

determining whether a post print mode completion time has passed when it is determined in a current instance of the continuing that the amount of the developer is equal to or less than the threshold;

stopping the supplying of the developer when it is determined that the post print mode completion time has passed; and again repeating the continuing after a determination is made that the post print mode completion time has not passed.

7. A device for controlling a supply of a developer comprising:

a sensing unit for sensing an amount of the developer in response to at least one of a first and second sensing instruction signal;

a determination unit for comparing the sensed amount with a reference threshold and for outputting the comparison result as a first supply control signal; and a developer supply unit for controlling supplying of the developer in accordance with the first supply control signal;

wherein the first sensing instruction signal is generated during a warm-up operation, and the second sensing instruction signal is generated in accordance with the first supply control signal;

wherein the determination unit determines whether a warm-up completion time has passed and outputs at least one of the determination result and the comparison result as the first supply control signal; and wherein a given flag is changed to a value of the first supply control signal, when it is determined that the warm-up completion time has passed;

wherein said flag is analyzed at a future time to determine whether an amount of the developer is greater than the threshold.

8. A device for controlling a supply of a developer comprising:

a flag analyzing unit for analyzing a given flag in response to a print instruction signal and for outputting the analysis result as a first supply control signal;

a sensing unit for sensing an amount of the developer in response to the first supply control signal;

a developer supply unit for controlling the supply of the developer in accordance with a second supply control signal and the first supply control signal such that the supply of the developer is continued while the first and second supply control signals each have specific predetermined values, and the supply of developer is stopped and an image is printed when at least one of the first and second supply control signals has a value different from its respective predetermined value; and a determination unit for comparing the sensed result with a predetermined threshold and for outputting the comparison result as the second supply control signal;

wherein the flag indicates the result of comparing the threshold with the amount of the developer sensed during a warm-up operation; and wherein the determination unit determines whether a print starting time has passed and outputs at least one of the determination result and the comparison result as the second supply control signal.

9. A device for controlling a supply of a developer comprising:

a flag analyzing unit for analyzing a given flag in response to a post print mode entrance instruction signal and outputting the analysis result as a first supply control signal;

a sensing unit for sensing an amount of the developer in response to the first supply control signal;

a developer supply unit for controlling the supply of the developer in accordance with a second supply control signal and the first supply control signal such that the supply of the developer is continued while the first and second supply control signals each have specific predetermined values, and the supply of developer is stopped and an image is printed when at least one of the first and second supply control signals has a value different from its respective predetermined value; and a determination unit for comparing the sensed result with a predetermined threshold and outputting the comparison result as the second supply control signal;

wherein the flag indicates the result of comparing the threshold with the amount of the developer sensed while a printing job is being performed; and wherein the determination unit determines whether a post print mode completion time has passed and outputs at least one of the determination result and the comparison result as the second supply control signal.

10. A non-transitory computer readable medium having embodied thereon a computer program for executing a method of controlling a supply of a developer, the method comprising:

sensing an amount of the developer;

determining whether the sensed amount is equal to or less than a predetermined threshold;

supplying the developer and repeating the sensing when a determination is made that the sensed amount is equal to or less than the threshold; and stopping the supplying of the developer when a determination is made that the sensed amount is greater than the threshold;

wherein the sensing, the determining, the supplying and the stopping are performed during a warm-up operation; and wherein the supplying comprises:

determining whether a warm-up completion time has passed when it is determined that the sensed amount is equal to or less than the threshold, and stopping the supplying of the developer when it is determined that the warm-up completion time has passed; and changing a given flag to a value indicating the result of comparing the sensed amount of the developer with the threshold, when it is determined that the warm-up completion time has passed;

wherein said flag is analyzed at a future time to determine whether an amount of the developer is greater than the threshold.

11. The non-transitory computer readable medium of claim 10, wherein the supplying further comprises supplying the developer and repeating the sensing, when a determination is made that the warm-up completion time has not passed.

* * * * *